US007055350B2

(12) United States Patent
Bonnain et al.

(10) Patent No.: US 7,055,350 B2
(45) Date of Patent: Jun. 6, 2006

(54) PACKAGING SYSTEM, APPARATUS AND METHOD THEREFOR

(75) Inventors: Jean-Christophe Bonnain, Chateauroux (FR); Arnaud Boutin, Maillet (FR); Frederic Chabanne, Chateauroux (FR); Olivier Quibel, Chateauroux (FR)

(73) Assignee: MeadWestvaco Packaging Systems LLC, Stamford, CT (US)

( * ) Notice: Subject to any disclaimer, the term of this patent is extended or adjusted under 35 U.S.C. 154(b) by 0 days.

(21) Appl. No.: 10/807,712

(22) Filed: Mar. 19, 2004

(65) Prior Publication Data

US 2004/0243277 A1 Dec. 2, 2004

Related U.S. Application Data

(63) Continuation of application No. PCT/US02/29864, filed on Sep. 20, 2002.

(30) Foreign Application Priority Data

Sep. 20, 2001 (GB) ..... 0122675.2

(51) Int. Cl.
*G06F 19/00* (2006.01)

(52) U.S. Cl. ..... 70/97

(58) Field of Classification Search ..... 700/17, 700/83, 90, 95, 97, 180; 53/49
See application file for complete search history.

(56) References Cited

U.S. PATENT DOCUMENTS

| | | | | |
|---|---|---|---|---|
| 4,501,106 | A | 2/1985 | Treiber | |
| 5,385,438 | A | 1/1995 | Fadaie | |
| 5,552,995 | A | 9/1996 | Sebastian | |
| 5,689,435 | A | 11/1997 | Umney | |
| 5,768,149 | A | 6/1998 | Umney | |
| 6,003,284 | A | 12/1999 | Goodman | |
| 6,125,374 | A * | 9/2000 | Terry et al. | 715/502 |
| 6,187,601 | B1 | 2/2001 | Hu et al. | |
| 6,689,035 | B1 * | 2/2004 | Gerber | 493/320 |
| 6,748,285 | B1 * | 6/2004 | Bozich et al. | 700/97 |
| 6,882,892 | B1 * | 4/2005 | Farrah et al. | 700/97 |
| 2002/0137615 | A1 * | 9/2002 | Shida et al. | 493/29 |

FOREIGN PATENT DOCUMENTS

| | | | |
|---|---|---|---|
| DE | 19831867 | A | 1/2000 |
| EP | 1106513 | A | 6/2001 |
| GB | 23 11 759 | A | 10/1997 |
| WO | 97/45322 | A1 | 12/1997 |

* cited by examiner

*Primary Examiner*—Leo Picard
*Assistant Examiner*—Ryan A. Jarrett
(74) *Attorney, Agent, or Firm*—Tsugihiko Suzuki; Parks Knowlton LLC; Cynthia R. Parks, Esq.

(57) ABSTRACT

Known packaging machines are only able to package objects in a limited number of arrangements usually limited to a single pack type. The present invention provides a server and client arrangement in which a user makes a number of selections respectively based upon a number of criteria in order to custom design packed objects. A rendered simulation of the packed objects is displayed by the client and is viewable from user selected angles. Once designed, the user instructs the server, via the client, to control a laser printer, a cutting table and a robotic packaging machine in order to produce a selected printed pack type and pack selected objects into the selected printed pack type.

35 Claims, 4 Drawing Sheets

PACKAGING SYSTEM, APPARATUS AND METHOD THEREFOR

This is a continuation of international application No. PCT/US02/29864, filed Sep. 20, 2002, which is hereby incorporated by reference.

BACKGROUND OF THE INVENTION

The present invention relates to a packaging system of the type used to package objects, for example an arrangement of products. The present invention also relates to apparatus and a method for the above-mentioned packaging system.

In the pulp-based packaging industry, objects, for example bottles, are packaged according to a desired arrangement of the objects by packaging machines. The packaging machines use pre-printed package blanks to form packages around objects to be packed.

It is appreciated in the art that a given packaging machine can usually only package a limited number of arrangements of objects. Furthermore, deviation from the limited number of arrangements is only possible to a limited degree and would typically require time consuming and expensive mechanical and/or software modifications to the given packaging machine. In fact, adaptation of a packaging machine to pack different types, or different combinations of types, of objects is difficult and sometimes unfeasible. In addition, variation of printed matter carried by the package blanks used by the packaging machine usually requires a time consuming approval process between a manufacturer of the objects and the producer and/or printer of the package blanks.

SUMMARY OF THE INVENTION

According to a first aspect of the present invention, there is provided a client apparatus for a packaging system, the client being capable of communicating with a server via a communications link, wherein the client comprises an input device, an output device and a processing unit that supports a user interface presented by the output device, the processing unit being arranged to permit a user, when in use, to make via the user interface a number of selections respectively based upon a number of packaging criteria for packaging at least one object and render via the output device a simulation of the at least one object packaged in response to the number of selections; the client is further arranged to communicate first output data to the server in response to a command initiated by the user.

Preferably, the first output data corresponds to an instruction to initiate packaging of the at least one object according to the number of selections made.

Preferably, the number of packaging criteria comprises arrangement of the at least one object.

Preferably, the at least one object comprises a set of different-shaped objects. More preferably, the number of criteria comprises shapes of the different-shaped objects.

Preferably, the number of criteria comprises a shape of the at least one object.

Preferably, the number of criteria comprises a packaging type. More preferably, the number of criteria comprises location of the at least one object within a package of the packaging type.

Preferably, the number of criteria comprises printed matter to be carried by a package for the at least one object.

Preferably, the package is a three-dimensional rendering of the packaged at least one object. More preferably, the three-dimensional rendering of the packaged at least one object is manipulatable by the user so as to be viewable from a number of viewing angles.

According to a second aspect of the present invention, there is provided a server being capable of communicating with a client via a communications link, wherein the server comprises a processing unit arranged, when in use, to permit a user to make a number of selections respectively based upon a number of packaging criteria for packaging at least one object, and generate rendering data corresponding to a simulation of the at least one object packaged according to the number of selections; the server is further arranged to communicate the rendering data to the client for display to the user and receive first output data from the client.

Preferably, the first output data corresponds to an instruction to initiate packaging of the at least one object according to the number of selections made.

According to a third aspect of the present invention, there is provided a terminal apparatus comprising an input device, an output device and a processing unit, the processing unit arranged, when in use, to permit a user to make a number of selections respectively based upon a number of packaging criteria for packaging at least one object, and render via the output device a simulation of the at least one object packaged according to the number of selections; the terminal is further arranged to generate first output data.

Preferably, the first output data corresponds to an instruction to initiate packaging of the at least one object according to the number of selections made.

Preferably, the number of packaging criteria comprises arrangement of the at least one object.

Preferably, the at least one object comprises a set of different-shaped objects.

Preferably, the number of criteria comprises shapes of the different-shaped objects.

Preferably, the number of criteria comprises a shape of the at least one object.

Preferably, the number of criteria comprises a packaging type.

Preferably, the number of criteria comprises a location of the at least one object within a package of the packaging type.

Preferably, the number of criteria comprises printed matter to be carried by a package for the at least one object.

Preferably, the apparatus is further arranged to generate first control data for a packaging machine capable of packaging the at least one object according to the number of selections made.

Preferably, the apparatus is further arranged to generate second control data for a cutting machine capable of cutting a package blank so as to form, when assembled, a package corresponding to one or more selection made.

Preferably, the apparatus is further arranged to generate third control data for controlling a printing device, the printing device being arranged to apply user-defined printed matter to material for use in forming a package blank.

Preferably, the apparatus is further arranged to receive the third control data and generate motor control data for controlling motors of the packaging machine over a predetermined period of time, thereby controlling the packaging machine, so as to package the at least one object.

Preferably, the package is a three-dimensional rendering of the packaged at least one object. More preferably, the three-dimensional rendering of the packaged at least one object is manipulatable by the user so as to be viewable from a number of viewing angles.

According to a fourth aspect of the present invention, there is provided a packaging system comprising a client capable of communicating with a server via a communications link, the server being capable of communicating with a packaging machine, and arranged to permit a user to make a number of selections respectively based upon a number of packaging criteria for packaging at least one object, and render via the client a simulation of the at least one object packaged according to the number of selections; the client is arranged to communicate first output data to the server in response to a command initiated by the user.

Preferably, the first output data corresponds to an instruction to initiate packaging of the at least one object according to the number of selections.

Preferably, the system is further is arranged to generate in response to the first output data first control data for the packaging machine, the packaging machine being capable of packaging the at least one object according to the number of selections made.

Preferably, the system is further arranged to generate second control data for a cutting machine capable of cutting a package blank that forms, when assembled, a package corresponding to the number of selections made.

Preferably, the system is further arranged to generate third control data for controlling a printing device, the printing device being arranged to apply printed matter to material for use in forming a package blank.

According to a fifth aspect of the present invention, there is provided a method of generating output data for a packaging system. The method comprises the steps of making a number of selections respectively based upon a number of packaging criteria relating to packaging of the at least one object, rendering a simulation of the at least one object packaged according to the number of selections, and generating first output data.

Preferably, the method is directed to the generation of the output data for packaging at least one object. More preferably, the output data is control data for a packaging machine so as to cause the packaging machine to package the at least one object according to the number of selections made.

Preferably, the method further comprises the step of: generating second control data for a cutting machine capable of cutting a package blank so as to form, when assembled, a package corresponding to one or more selection made.

Preferably, the method further comprises the step of: generating third control data for controlling a printing device, the printing device being arranged to apply user-defined printed matter to material for use in forming a package blank.

Preferably, the process of packaging the at least one object is repeated.

According to a sixth aspect of the present invention, there is provided a computer program element comprising computer program code means to make a computer execute the method as set forth above in accordance with the fifth aspect of the present invention. Preferably, the computer program element is embodied on a computer readable medium.

According to a seventh aspect of the present invention, there is provided computer executable software code stored on a computer readable medium, the code being for packaging of at least one object, the code comprising: code to make a number of selections respectively based upon a number of packaging criteria relating to packaging of the at least one object; code to render a simulation of the at least one object packaged according to the number of selections made; code to generate first output data.

Preferably, the first output data is first control data for a packaging machine so as to cause the packaging machine to package the at least one object according to the number of selections made.

According to an eighth aspect of the present invention, there is provided a programmed computer for generating control data for controlling a packaging machine, comprising memory having at least one region for storing computer executable program code, and a processor for executing the program code stored in the memory, wherein the program code includes: code to receive output data corresponding to a number of selections made respectively based upon a number of packaging criteria relating to packaging of the at least one object; code to generate rendering data corresponding to a simulation of the at least one object packaged according to the number of selections; code to generate first output data.

Preferably, the first output data is first control data for the packaging machine so as to cause the packaging machine to package the at least one object according to the number of selections made.

According to a ninth aspect of the present invention, there is provided a computer readable medium having computer executable software code stored thereon, the code being for packaging of at least one object and comprising: code to make a number of selections respectively based upon a number of packaging criteria relating to packaging of the at least one object; code to render a simulation of the at least one object packaged according to the number of selections; code to generate first output data.

Preferably, the first output data is first control data for a packaging machine so as to cause the packaging machine to package the at least one object according to the number of selections made.

According to a tenth aspect of the present invention, there is provided a control signal adapted to actuate motors of a packaging machine in a manner so as to package at least one object according to a number of selections made respectively based upon a number of packaging criteria relating to packaging of the at least one object.

According to an eleventh aspect of the present invention, there is provided a use of a client-server arrangement in order to design a package for at least one object and package the at least one object in the package.

It is thus possible to provide a packaging system, apparatus and method therefor that is capable of providing the user with flexibility of choice as to combinations of packed product shapes, the type of package used and arrangement of the objects within the package type selected. The user also has the ability to select and create printed matter to be applied to the package. Advantageously, the design of the package and subsequent fabrication thereof can be achieved in real time.

BRIEF DESCRIPTION OF THE DRAWINGS

At least one embodiment of the invention will now be described, by way of example only, with reference to the accompanying drawings in which.

DETAILED DESCRIPTION OF THE PREFERRED EMBODIMENTS

Figure 1:
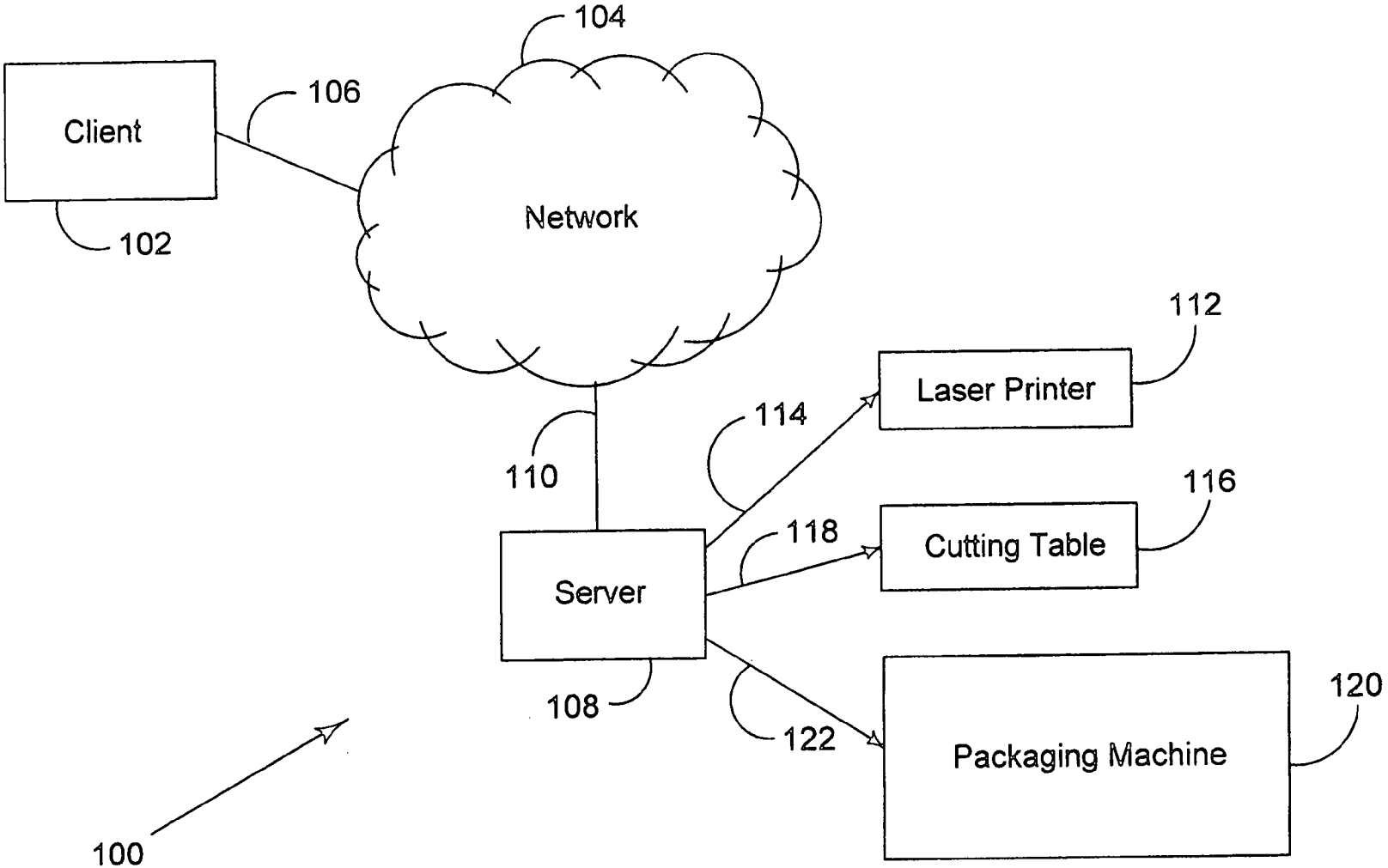
FIG. 1 is a schematic diagram of a packaging system constituting an embodiment of the invention.

Throughout the following description, identical reference numerals will be used to identify like parts.

Referring to FIG. 1, a packaging system 100 comprises a client terminal 102 coupled to a communications network 104, via a first communications link 106. A server 108 is coupled to the communications network 104 via a second communications link 110. In the present example, the communications network 104 is the Internet and so the client terminal 102 is capable of communicating packets of data with the server 110 which are routed through the Internet.

The server 108 is coupled to a printing apparatus, such as a laser printer 112 via a third communications link 114, such as a serial connection. A cutting apparatus for cutting carton board (not shown) into package blanks (not shown), for example a cutting table 116 is also coupled to the server 108 via a fourth communications link 118. The cutting table 116 is configured to receive control instructions from the server 108 and cut the carton board in accordance with the control instructions to form the package blanks. The control instructions can be varied in order to enable the server 108 to control the shape and/or configuration of the package blanks. The cutting table 116 can be any suitable cutting table known in the art, for example as manufactured by Barco Graphic Systems.

A robotic packaging machine 120 is coupled to the server 108 via a fifth communications link 122. Although the third, fourth and fifth communications links 114, 118, 122 are individual links in this example, the laser printer 112, the cutting table 116, and the packaging machine 120 can each be coupled to a Local Area Network (LAN). The laser printer 112 and the cutting table 116 are, in this example, coupled to each other, the cutting table 116 being coupled to the packaging machine 120. Consequently, a production line is formed in which the work product of the laser printer 112 can be passed to the cutting table 116 and the work product of the cutting table 116 can be passed to the packaging machine 120.

Figure 2:
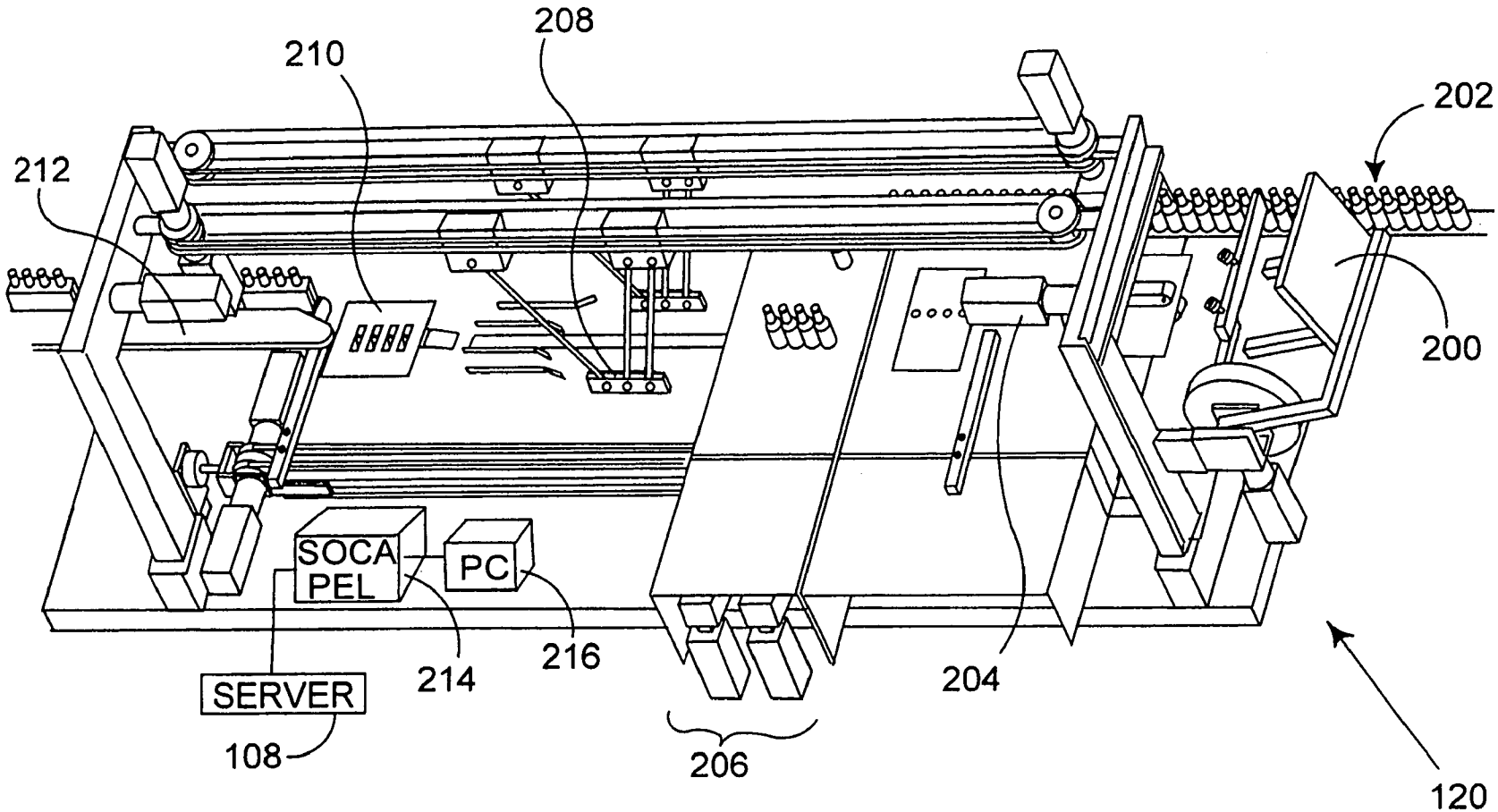
FIG. 2 is a schematic diagram of a robotic packaging machine for use with the system of FIG. 1.

Referring to FIG. 2, the packaging machine 120 comprises a hopper 200 for receiving printed packaging blanks (not shown) from the cutting machine 116. A rotary feeder 202 is coupled to the hopper 200 for taking the printed packaging blanks from the hopper 200 and feeding the printed packaging blanks onto an in-feed conveyor 204. An article (or object) feeder 206 is coupled to an end of the in-feed conveyor 204 distal from the rotary feeder 202 for selecting, arranging and loading objects to be packed. A carton folding and loading robot 208 is coupled adjacent the article feeder 206. A locking apparatus 210 is disposed adjacent the carton folding and loading robot 208 for locking the package assembled so that it retains its shape and mechanical properties. An out-feed conveyor 212 is arranged adjacent the locking apparatus 210 in order to convey the packed objects from the locking apparatus 210 out of the packaging machine 120. The carton folding and loading robot 208 comprises a number of actuatable motors which enable the robot 208 to flexibly manipulate the carton blanks with respect to the objects to be packed. A Socapel™ control unit 214 is coupled to the fifth communications link 122, the Socapel™ control unit 214 being coupled to a Personal Computer (PC) 216. The Socapel™ control unit 214 and the PC 216 interact to control movements of parts of the packaging machine 120, including the number of actuatable motors mentioned above.

Figure 3:
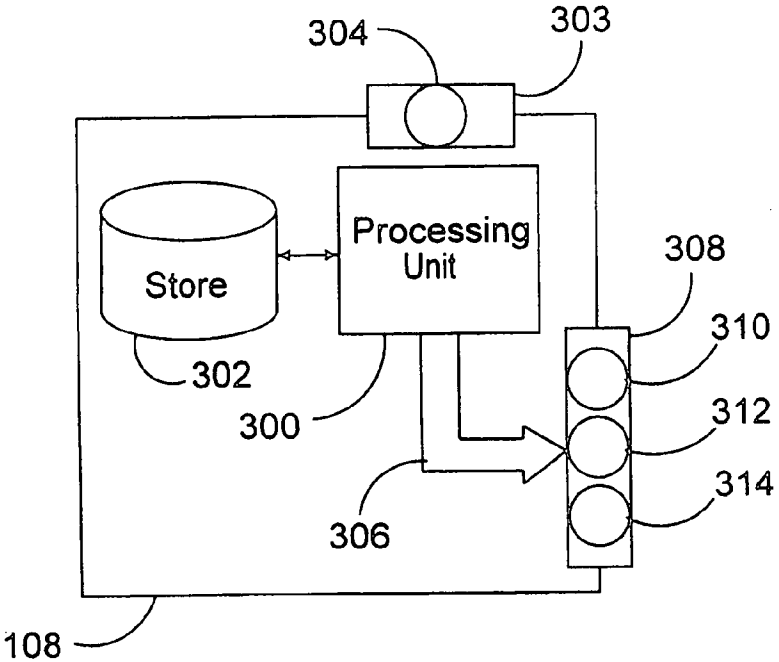
FIG. 3 is a schematic diagram of a server of FIG. 1.

Referring to FIG. 3, the server 108 comprises a processing unit 300 coupled to a storage device 302, for example a hard drive. The processing unit 300 is also coupled to a first input/output (I/O) interface 303 having a network I/O port 304 for accessing the Internet.

A data bus 306 couples the processing unit 300 to a second I/O interface 308 having a first I/O port 310, a second I/O port 312, and a third I/O port 314.

The processing unit 300 is programmed, in this example, to generate control data for use by the laser printer 112, the cutting table 116 and the packaging machine 120.

Figure 5:
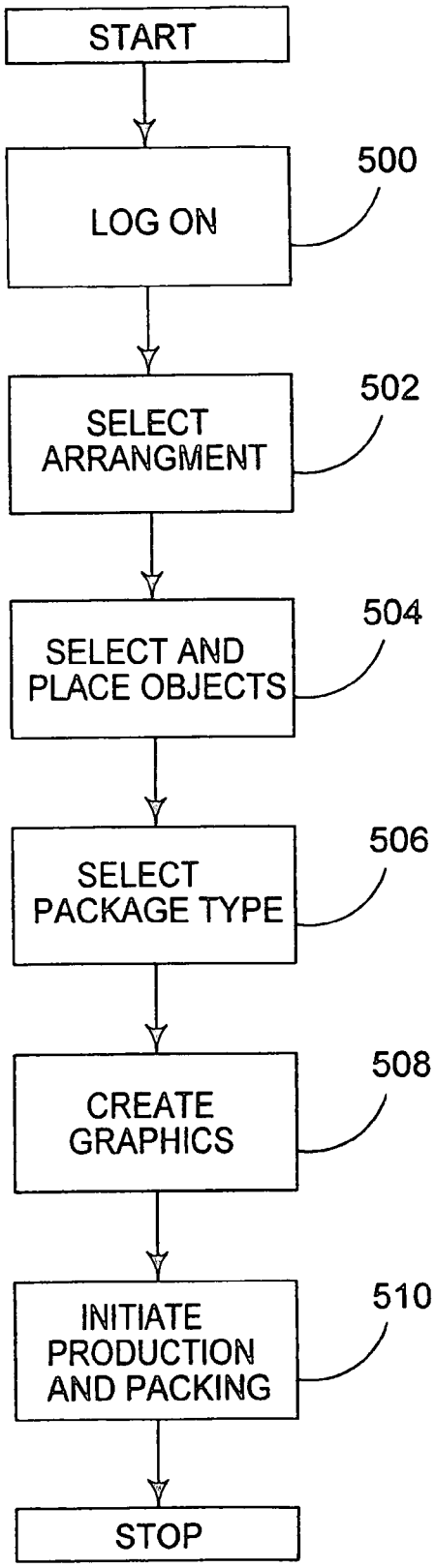
FIG. 5 is a flow diagram of a method that can be carried out by the system of FIG. 1.

In operation (FIG. 5), an in-tray (not shown) of the laser printer 112 is filled with carton boards and objects, such as bottles, are fed to the article feeder 206 of the packaging machine 120 for packaging. The user, typically remote from the server 108 and the packaging machine 120, accesses (Step 500) a URL corresponding to packaging software on the server 108, for example, www.mead.com/imagen using web browsing software, such as Microsoft™ Internet Explorer or Netscape Navigator, provided on the client terminal 102. The client terminal 102 comprises a PC including an input device and an output device. The user uses the web browsing software to navigate through a number of HTML web pages generated by the server 108. The number of HTML web pages enables the user to make a number of choices respectively based upon a number of criteria related to packaging of the objects.

In this example, a first web page is presented to the user and the user is requested to select (Step 502) an arrangement of bottles (Criterion 1) from a selection of available arrangements shown, for example, 1×3, 1×4, 2×2, 2×3, 3×3, 3×4, Q1×2, Q1×2×1, Q2×3,Q1×2×3,Q2×3×2, or Q1×2×2×1. The user selects one of the bottle arrangements and is then presented with a second web page containing a Cult3D software interface (available from Cycone AB) permitting the user to select and place bottles (Step 504) from a range of differently shaped bottles (Criterion 2) in spaces available in the packaging arrangement previously selected. The spaces available can be filled with identically shaped bottles or differently shaped bottles. As the bottles are selected and placed in the available spaces, the bottles are rendered in the selected places by the server 108, the rendering data being transmitted by the server 108 to the client terminal 102 for presentation to the user. At this stage, the user is able to rotate the placed bottles about three axes in order to view the placed bottles from any angle desired. Once the bottles have been placed, the user is presented with a selection panel showing a number of selectable package types, for example end-loaded carriers, wrap around packages and/or basket carriers. Alternatively, the user can be presented with the selection panel, but showing a number of adaptable package types, the exact dimensions of a given adaptable package type being modifiable in response to, for example, the dimensions and relative location of each of the placed bottles (objects), i.e. parameters of the given adaptable package type are extracted from the dimension of one or more bottle and/or the relative location(s) of the one or more bottle.

The user is prompted to select (Step 506) one of the number of package types, for example, a shape of package desired (Criterion 3). The selected package type is then rendered by the server 108 so that the client terminal 102 displays a simulation of the selected bottles packaged. At this stage, not only can the user change the type of package, but the user is also free to move the bottles within the package and change the types of bottles shown in the simulated pack. Once the user has finished designing the pack insofar as the arrangement, package type, bottle type and siting of bottles are concerned, the user can select and/or create (Step 508) suitable graphics to be printed on one or more outer surface of the simulated pack. Each surface upon which printed matter can be disposed has a respective software design board associated therewith. The user can select each printable surface in turn for application of the printed matter thereto. Upon selection of a given surface, the user is presented with a window having a blank region corresponding to the surface of the pack selected to which printed matter can be applied. Using a Java applet, the user can load pre-stored graphics for pasting into the region. Alternatively, or additionally, the user can use a number of configurable graphic objects provided in a side-window to draw desired graphics in the region. Once the user has finished designing the given surface, the server 108 renders the packed bottles with the graphics design by the user; this is shown by the client terminal 102. Again, the user is able to view the designed package from any angle desired.

The above process of designing graphics can be repeated for each printable surface of the pack. Again, the user is able to view the printed simulated pack from all available angles. Once the user has completely finished designing the pack, the user selects (Step 510), for example, a "MAKE PACKS" button; this instruction is communicated by the client terminal 102 to the server 108.

Upon receipt of the instruction to make the packs, the server 108 begins processing the completed package design information. The graphics for each surface of the pack are converted into a png format file by the server 108 and a first text based script file is generated containing details regarding arrangement of the graphics on package blanks. The png file and the first text script file are processed by the server 108 resulting in the generation of an A3 pdf file. The A3 pdf file is communicated to the laser printer 112 via the first I/O port 310 and, upon receipt of the A3 pdf file, the laser printer begins to print the carton boards for use by the cutting table 116. The printed carton boards are fed to and taken by the cutting table 116.

The package layout and bottle configuration are stored by the server 108 in the storage device 302 as an XML file. The XML file is converted by the server 108 into a second text based script file using a first XSL file. The second script file is communicated to the cutting table 116 via the second I/O port 312 and ultimately converted, in this example, into control data in a control language known in the art and used by the cutting table 118. Using the control data effectively provided by the server 108, the cutting table 116 cuts the printed carton board provided from the laser printer 112 to produce printed package blanks. Once produced, the printed package blanks are fed to the packaging machine 120.

In order to control the packaging machine 120, a second XSL file is used to convert the XML file into a third text based script file that is used for programming the packaging machine 120. The third text based script file contains parameters relating to the pack, for example as illustratively shown in Table 1 below.

TABLE 1

| Parameter name | Value |
|---|---|
| Product diameter | 30 mm |
| Product height | 100 mm |
| . . . | . . . |

TABLE 1-continued

| Parameter name | Value |
|---|---|
| . . . | . . . |
| Number of rows | 2 |
| Number of columns | 2 |

Figure 4:
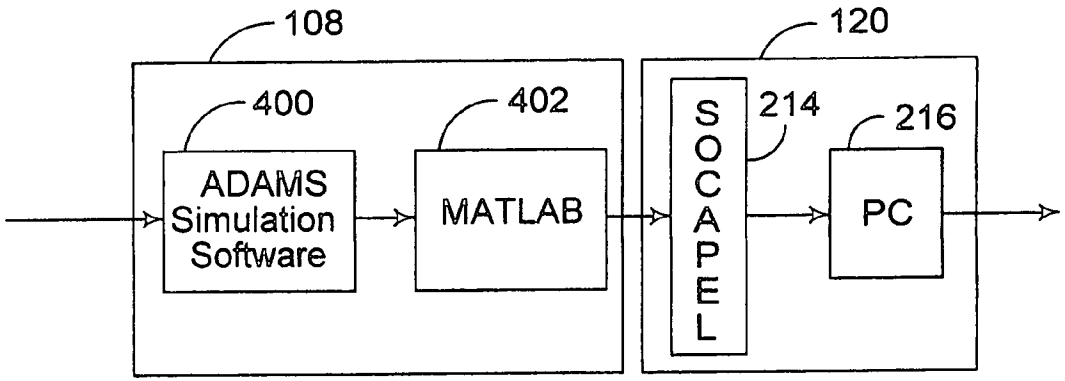
FIG. 4 is a schematic diagram of data processing stages executed between the server and the packaging machine of FIGS. 1 and 2.

Referring to FIG. 4, the server 108 executes ADAMS simulation software 400 available from ADAMS® Software. The ADAMS simulation software takes the third script file and generates a control output text file containing control data corresponding to motor actuations of the packaging machine 120 over a predetermined period of time. The motor actuations include and correspond to movements of the robot 208 of the packaging machine 120 necessary for the packaging machine 120 to form the pack designed by the user.

The control output text file is then processed by MATLAB software package 402, available from The MathWorks™, in order to scale and reformat the control data. The scaled and reformatted control data is stored as a .csv file. The .csv file is then communicated to the packaging machine 120 via the third I/O port 314 of the server 108. The .csv file is received by the Socapel control unit 214 of the packaging machine 120 and processed by the Socapel control unit 214 before transmission of the results of processing the .csv file to the PC 216 for programming of the packaging machine 120. Once programmed, the packaging machine 120 acts upon the data received to assemble the package blanks and package the bottles in accordance with the user's pack design.

In this respect, the laser printer 112 prints the carton boards with graphic design of the user, the carton boards being fed to the cutting table 116. The cutting table 116 cuts the carton boards received into package blanks so that, when assembled, the package blanks form the type/shape of carton selected by the user. The package blanks are fed to the hopper 200 of the packaging machine 120 and individually taken from the hopper 200 by the rotary feeder 202. The rotary feeder 202 feeds the package blanks onto the in-feed conveyor 204, where the package blanks are conveyed to the article feeder 206. Using electromagnets, the article feeder 206 selects the bottles chosen by the user and arranges the bottles in accordance with the user's selection. The package blanks are then manipulated with respect to the arranged bottles by the robot 208 so as to assemble the package by loading and folding the package blanks. After assembly of the package by the robot 208, the packed bottles are passed to the locking apparatus 210 for locking the package closed and then conveyed out of the packaging machine 120 by the out-feed conveyor 212.

Although the above example has been described in the context of bottles being packed, it should be appreciated that any objects can conceivably be packed, for example, products such as, and not exclusively limited to, batteries, perfumes, cosmetics, poultry. It should also be appreciated that although certain file types have been mentioned above, any suitable file types can be employed.

It should also be appreciated that the output, or control, data that is usually to be sent to the server can be generated in a context that does not include the printing apparatus, the cutting apparatus or the packaging machine. In such an example, the output data is simply generated for subsequent use by a manufacturer of packaging blanks and/or a packaging company to make the packaging blanks in accordance with at least part of the output data. Objects can, of course, subsequently be packaged by the packaging company in accordance with at least part of the output data.

In a further embodiment, the above example that excludes the printing apparatus, the cutting apparatus and the packaging machine can be further modified to forego selection by the user of bottle arrangements and the viewing of an assembled and populated package. Instead, the user simply selects a particular blank and the user can create and/or select suitable graphics to be printed on the package blank as already described above in relation to a previous example. The user is then able to view the simulated package blank, bearing the selected/created graphics. The output data will simply correspond to the combination of the selected package blank with graphics.

Alternative embodiments of the invention can be implemented as a computer program product for use with a computer system, the computer program product being, for example, a series of computer instructions stored on a tangible data recording medium, such as a diskette, CD-ROM, ROM, or fixed disk, or embodied in a computer data signal, the signal being transmitted over a tangible medium or a wireless medium, for example microwave or infrared. The series of computer instructions can constitute all or part of the functionality described above, and can also be stored in any memory device, volatile or non-volatile, such as semiconductor, magnetic, optical or other memory device.

The invention claimed is:

1. A system for controlling production of a package for enclosing at least one object, comprising:

a server, comprising:

input means for receiving package design criteria from a remote client device over a communications network;

a processor for:

generating simulation data based at least in part on the package design criteria, the simulation data including instructions for rendering a simulated image of the package; and generating fabrication control data and packaging control data based at least in part on the package design criteria; and output means for communicating the simulation data to the remote client device over the communications network, and for communicating the fabrication control data to a control unit associated with a fabrication device, the fabrication control data comprising fabrication instructions that cause the fabrication device to automatically produce at least part of the package, and for communicating the packaging control data to a control unit associated with a packaging device, the packaging control data comprising packaging instructions that cause a packaging device to automatically assemble at least part of the package.

2. The system of claim 1, wherein the server is remote with respect to the fabrication device, and the output means is further for communicating the fabrication control data to the control unit associated wit the fabrication device over the communications network.

3. The system of claim 1, wherein the package design criteria include at least one of the following parameters: number of objects to be packaged, dimensions of each object, shape or each object, arrangement of objects, package type, package dimensions, and package graphics.

4. The system of claim 1, wherein the communications network is the Internet.

5. The system of claim 1, wherein the fabrication control data comprises instructions that cause the fabrication device to automatically produce at least part of the package by performing at least one of the following actions: printing at least one carton board, and cutting the at least one carton board into at least one blank.

6. The system of claim 1, wherein the server further comprises a storage device for storing at least one of the package design criteria and the fabrication control data.

7. The system of claim 1, wherein the at least one object comprises a plurality of differently-shaped objects.

8. The system of claim 1, wherein the fabrication device comprises at least one of the following: means for cutting a package blank, and means for printing on a package blank.

9. The system of claim 1, wherein the packaging control data comprises packaging instructions that cause a packaging device to selectively position the at least one object.

10. The system of claim 9, wherein the packaging instructions that cause a packaging device to selectively position the at least one object include instructions for activating at least one electromagnet of the packaging device to grasp the at least one object.

11. The system of claim 10, wherein the at least one object is a bottle.

12. The system or claim 1, wherein the packaging control data comprises packaging instructions that cause a packaging device to fold a carton.

13. The system of claim 12, wherein the packaging instructions that cause a packaging device to fold a carton include instructions for actuating at least one motor of a folding robot.

14. The system or claim 13, wherein the packaging instructions that cause a packaging device to fold a carton include instructions for folding the carton around the at least one object.

15. The system of claim 1, wherein the packaging control data comprises packaging instructions that cause a packaging device to lock a carton.

16. The system of claim 15, wherein the packaging instructions that cause a packaging device to lock a carton include instructions for locking the carton round the at least one object.

17. A system for designing and producing a package, comprising:

a client device, comprising:

input means for receiving user selections of package design criteria, and for receiving simulation data from a remote server over a communications network;

output means for communicating the package design criteria to the remote server over the communications network, the remote server being for:

generating simulation data based at least in part on the package design criteria and communicating the simulation data to the client device; and generating fabrication control data and packaging control data based at least in part on the package design criteria, communicating the fabrication control data to a control unit associated with a fabrication device, the fabrication control data comprising fabrication instructions that cause the fabrication device to automatically produce at least part of the package, and communicating the packaging control data to a control unit associated with a packaging device, the packaging control data comprising packaging instructions that cause a packaging device to automatically assemble at least part of the package;

a client processor for rendering a simulated image of the package based at least in part on the simulation data; and display means for rendering the simulation in a graphical format viewable by the user.

18. The system of claim 17, wherein the output means is further for communicating the package design criteria in response to a command received from the user.

19. The system of claim 17, wherein the fabrication device is remote with respect to the server, and the server is configured to communicate the control data to the control unit associated with the fabrication device over the communications network.

20. The system of claim 17, wherein the package design criteria include at least one of the following parameters: number of objects to be packaged, dimensions of each object, shape of each object, arrangement of objects, package type, package dimensions, and package graphics.

21. The system of claim 17, wherein the communications network is the Internet.

22. The system of claim 17, wherein the fabrication control data comprises instructions that program the fabrication device to automatically produce at least part of the package by performing at least one of the following steps: printing at least one carton board, and cutting the at least one carton board into at least one blank.

23. The system of claim 17, wherein the server further comprises a storage device for storing at least one of the package design criteria and the fabrication control data.

24. The system of claim 17, wherein the at least one object comprises a plurality of differently-shaped objects.

25. The system of claim 17, wherein the fabrication device comprises at least one of the following: means for cutting a package blank, and means for printing on a package blank.

26. A computer readable medium having stored thereon executable code which causes a server to perform a method for controlling production of a package, the method comprising:

receiving package design criteria from a remote client device over a communications network;

generating simulation data based at least in part on the package design criteria, the simulation data including instructions for rendering a simulated image of the package;

generating fabrication control data and packaging control data based at least in part on the package design criteria;

communicating the fabrication control data to a control unit associated with a remote fabrication device, the fabrication control data comprising fabrication instructions that cause the fabrication device to automatically produce at least part of the package; and communicating the packaging control data to a control unit associated with a packaging device, the packaging control data comprising packaging instructions that cause the packaging device to assemble at least part of the package.

27. The computer readable medium of claim 26, wherein receiving package design criteria comprises receiving at least one of the following parameters: number of objects to be packaged, dimensions of each object, shape of each object, arrangement of objects, package type, package dimensions, and package graphics.

28. The computer readable medium of claim 26, wherein receiving package design criteria from a remote client device over a communications network comprises receiving package design criteria over the Internet.

29. The computer readable medium of claim 26, wherein communicating the fabrication control data comprises communicating instructions that cause the fabrication device to automatically produce the package by performing at least one of die following actions: printing at least one canon board, and cutting the at least one carton board into at least one blank.

30. The computer readable medium of claim 26, wherein the method further comprises storing at least one of the package design criteria and the fabrication control data.

31. A computer readable medium having stored thereon executable code which causes a client processor to perform a method for designing and producing a package, the method comprising:

receiving user selections of package design criteria;

communicating the package design criteria to a remote server over a communications network, the package design criteria including information for causing the remote server to generate fabrication control data and packaging control data based at least in part on the package design criteria, the fabrication control data comprising instructions for causing a fabrication device to automatically produce at least part of the package, the packaging data comprising packaging instructions for causing a packaging device to assemble at least part of the package;

receiving simulation data from the remote server based at least in part on the package design criteria; and rendering a simulated image of the package based at least in part on the simulation data.

32. The computer readable medium of claim 31, wherein the method further comprises communicating the package design criteria in response to a command received from the user.

33. The computer readable medium of claim 31, wherein receiving user selection of the package design criteria includes receiving at least one of the following parameters: number of objects to be packaged, dimensions of each object, shape of each object, arrangement of objects, package type, package dimensions, and package graphics.

34. The system of claim 31, wherein communicating the package design criteria over a communications network comprises communicating over the Internet.

35. The system of claim 31, wherein the package design criteria further includes information for causing the remote server to generate fabrication control data which includes instructions that program the fabrication device to automatically produce at least part of the package by performing at least one of the following steps: printing at least one carton board, and cutting the at least one carton board into at least one blank.

* * * * *